US006564942B1

(12) United States Patent
Shiffler et al.

(10) Patent No.: US 6,564,942 B1
(45) Date of Patent: May 20, 2003

(54) WOUND FILM DISPENSER AND METHOD FOR MANUFACTURING SAME

(75) Inventors: Cristopher M. Shiffler, Orem, UT (US); Nichole M. Chagnon, Milwaukee, WI (US); Rene M. Beland, Racine, WI (US); Billy R. Stroud, Camanche, IA (US); Alan John Linder, Waukesha, WI (US); Peter Rivard, Saint Paul, MN (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 51 days.

(21) Appl. No.: 09/711,017

(22) Filed: Nov. 13, 2000

(51) Int. Cl.[7] ..... B65D 85/67

(52) U.S. Cl. ..... 206/395; 206/397; 206/408; 242/588.4

(58) Field of Search ..... 206/395–397, 206/409, 408; 225/47, 48, 50, 90; 242/588.4, 588.6, 598.6

(56) References Cited

U.S. PATENT DOCUMENTS

| | | | | |
|---|---|---|---|---|
| 1,076,635 A | | 10/1913 | Howard | |
| 1,082,964 A | | 12/1913 | Macdonald | |
| 1,691,995 A | | 11/1928 | Saulter | |
| 1,907,922 A | * | 5/1933 | Willis | 225/47 |
| 2,330,117 A | * | 9/1943 | Feinberg | 242/588.4 |
| 2,458,844 A | | 1/1949 | Foote | |
| 2,472,521 A | | 6/1949 | Danenbauer | |
| 2,507,403 A | | 5/1950 | Gluck | |
| 2,624,521 A | | 1/1953 | Broeren | |
| 2,743,009 A | | 4/1956 | Williamson et al. | |
| 2,748,931 A | | 6/1956 | Taylor | |
| 2,799,393 A | | 7/1957 | Klein | |
| 2,803,339 A | | 8/1957 | Kuchenbecker | |
| 2,853,185 A | | 9/1958 | Rollie | |
| 2,864,493 A | | 12/1958 | Holcombe | |
| 3,121,542 A | | 2/1964 | Van Dyke et al. | |
| 3,128,025 A | | 4/1964 | Buttery et al. | |
| 3,159,323 A | | 12/1964 | Hawk | |
| 3,166,187 A | | 1/1965 | Araujo | |
| 3,228,579 A | | 1/1966 | Dong et al. | |
| 3,246,742 A | | 4/1966 | Coe | |
| 3,262,620 A | | 7/1966 | Burt et al. | |
| 3,458,109 A | | 7/1969 | Compton et al. | |
| 3,477,624 A | | 11/1969 | Branyon et al. | |
| 3,530,980 A | | 9/1970 | Link | |
| 3,587,840 A | | 6/1971 | Hultberg | |
| 3,613,973 A | | 10/1971 | Jaeschke | |
| 3,685,644 A | | 8/1972 | Cothran et al. | |
| 3,698,548 A | * | 10/1972 | Stenzel et al. | 206/395 |
| D232,081 S | | 7/1974 | Zine, Jr. | |
| 4,062,447 A | | 12/1977 | Gardner | |
| 4,151,914 A | | 5/1979 | Blatt | |
| 4,238,065 A | | 12/1980 | Ragsdale | |
| 4,298,123 A | | 11/1981 | Roccaforte et al. | |
| D267,544 S | | 1/1983 | Neto et al. | |
| 4,373,687 A | | 2/1983 | Zicko | |
| 4,667,824 A | | 5/1987 | Ditchfield | |

(List continued on next page.)

FOREIGN PATENT DOCUMENTS

| | | |
|---|---|---|
| SE | 38587 | 3/1915 |
| WO | WO 00/15729 | 3/2000 |

*Primary Examiner*—Byron P. Gehman

(57) ABSTRACT

A carton for retaining, suspending, and dispensing rolls of wound web material and a method of manufacturing same are disclosed. The carton is a trunk to which a lid is hinged to allow the lid to be opened and closed and thereby allow access to the roll of wound web material. Retainers are provided at first and second ends to positively hold the roll within the carton for dispersal of the film. The retainers may also suspend the roll off of the bottom wall of the carton to avoid adhesion of the multiple layers of wound web of material, particularly materials employing pressure sensitive adhesives. A carton includes guide surfaces to facilitate automated assembly of the carton.

10 Claims, 9 Drawing Sheets

U.S. PATENT DOCUMENTS

| | | | |
|---|---|---|---|
| 4,715,519 | A | 12/1987 | Fischer |
| 4,813,539 | A | 3/1989 | Church et al. |
| 4,925,028 | A | 5/1990 | Smith |
| D313,752 | S | 1/1991 | Dyble |
| 4,998,656 | A | 3/1991 | Hurh |
| D325,311 | S | 4/1992 | Mygind |
| 5,121,839 | A | 6/1992 | Lapp |
| 5,141,108 | A | 8/1992 | Roccaforte |
| 5,449,070 | A | 9/1995 | Broderick |
| 5,484,082 | A | 1/1996 | Casper et al. |
| 5,511,663 | A | 4/1996 | Shimura et al. |
| D372,387 | S | 8/1996 | Kuchenbecker |
| D383,934 | S | 9/1997 | McNaughton |
| 5,662,758 | A | 9/1997 | Hamilton et al. |
| D395,823 | S | 7/1998 | Durand |
| 5,871,607 | A | 2/1999 | Hamilton et al. |
| D414,061 | S | 9/1999 | Peachey |
| 5,971,150 | A | 10/1999 | Anderson et al. |

* cited by examiner

WOUND FILM DISPENSER AND METHOD FOR MANUFACTURING SAME

FIELD OF THE INVENTION

The invention generally relates to dispensers and, more particularly, relates to dispensers for use in conjunction with wound films such as plastic wrap, aluminum foil, wax paper, and the like.

BACKGROUND OF THE INVENTION

Cartons for the storage and dispersal of rolls of wound flexible film are well-known. Such cartons are typically manufactured from paperboard material and folded into a configuration conventionally referred to as a trunk-lid box wherein a base or box of the carton forms an enclosure for the roll with an open top, and the lid is folded relative to the trunk to form a natural hinge and thereby allow the lid to close the trunk.

A number of criteria need to be considered when manufacturing such a carton. One concern is the ease with which the material can be drawn from the roll. This criteria is a function of a number of variables including the type of material wound onto the roll, the manner in which the roll is positioned or placed within the carton, and the angle at which the material must be pulled from the carton. For example, if the material is of a high-tack quality, it may tend to adhere to itself thereby requiring a relatively high level of force to pull the material from the roll. Depending upon the degree of tack to the film, and the angle at which the material is pulled from the carton, the roll itself may tend to be pulled completely out of the carton, creating a source of frustration for the user. Moreover, once the roll is pulled from the carton, the risk of contamination of the film is increased.

Mechanisms have therefore been devised which perform a retention feature within the carton. In other words, the roll itself may be physically held within the carton such that upon a user pulling on the film, the roll is held against the force created by the user, while still enabling the roll to rotate and thereby dispense film. For example, U.S. Pat. No. 4,998,656, assigned to the present assignee, discloses a roll restraining dispensing carton wherein opposite ends of the carton include collars for retaining the roll within the carton. The collars include apertures which circumnavigate the ends of the roll to thereby physically hold the roll within the carton, and also provide a bearing surface around which the roll may rotate.

One further concern arises when the wound film is of a pressure sensitive adhesive variety. In such a situation, the weight of the roll resting upon itself may cause the individual layers of the film to adhere and thereby prevent, or severely hinder, dispersal of the film. It is therefore advantageous in such situations to mount the roll within the carton in a suspended manner such that the core of the roll is mounted for rotation, but wherein the film wound upon the roll is not resting upon itself. Such a suspension feature is also disclosed in the aforementioned U.S. Pat. No. 4,998,656.

While such a carton has proven to be successful, it would be advantageous to continue to improve such features. In addition, such cartons are typically manufactured and loaded with rolls of wound film in an automated process. It would therefore be advantageous to improve the ease of manufacturability of the carton as well.

SUMMARY OF THE INVENTION

In accordance with one aspect of the invention, a film dispenser is provided which comprises a body, a lid hinged to the body, a roll of film, and first and second retainers. The body includes a base, first and second sides extending orthogonally from the base, and first and second ends extending from the base. The body defines an interior channel. The lid is hinged to the body and movable between closed and open positions. The lid prevents user access to the interior channel when in the closed position, whereas the interior channel is user accessible when the lid is in the open position. The roll of film is positioned within the interior channel and includes a core around which is wound a web of film. The web is narrower than the core and includes first and second ends. The first and second retainers are positioned proximate the first and second body ends, and each include a bearing plate substantially parallel to one of the first and second body ends, a spacer interconnecting the top edge of the bearing plate to a top edge of one of the first and second body ends, and a flap connecting a bottom edge of the bearing plate to the base of the body. The spacer and flap are substantially parallel to the body base and each end plate includes an aperture receiving one of the core ends.

In accordance with another aspect of the invention, a method of assembling a dispenser for rolls of wound web material is provided which comprises the steps of inserting a roll of wound web material into a tubular body having first and second opposed ends, and folding first and second end walls hinged to the tubular body toward the first and second opposed open ends, respectively. The roll includes a core around which web material is wound, wherein the web material is narrower than the core. The core includes first and second ends free of web material. The first and second ends of the core are captured in retaining apertures provided in the first and second end walls during the folding step.

In accordance with another feature of the invention, a dispenser for rolls of wound film is provided which comprises a trunk, a lid, and first and second retainers. The roll includes a core having first and second hollow ends, with film wound around the core. The film has a width less than the width of the core. The lid is hinged to the trunk and the first and second retainers are connected to the trunk and extend into an interior channel. First and second retainers penetrate into the hollow ends of the core to retain and suspend the core within the trunk.

These and other aspects and features of the invention will become more apparent from the following detailed description when taken in conjunction with the accompanying drawings.

Figure 1:
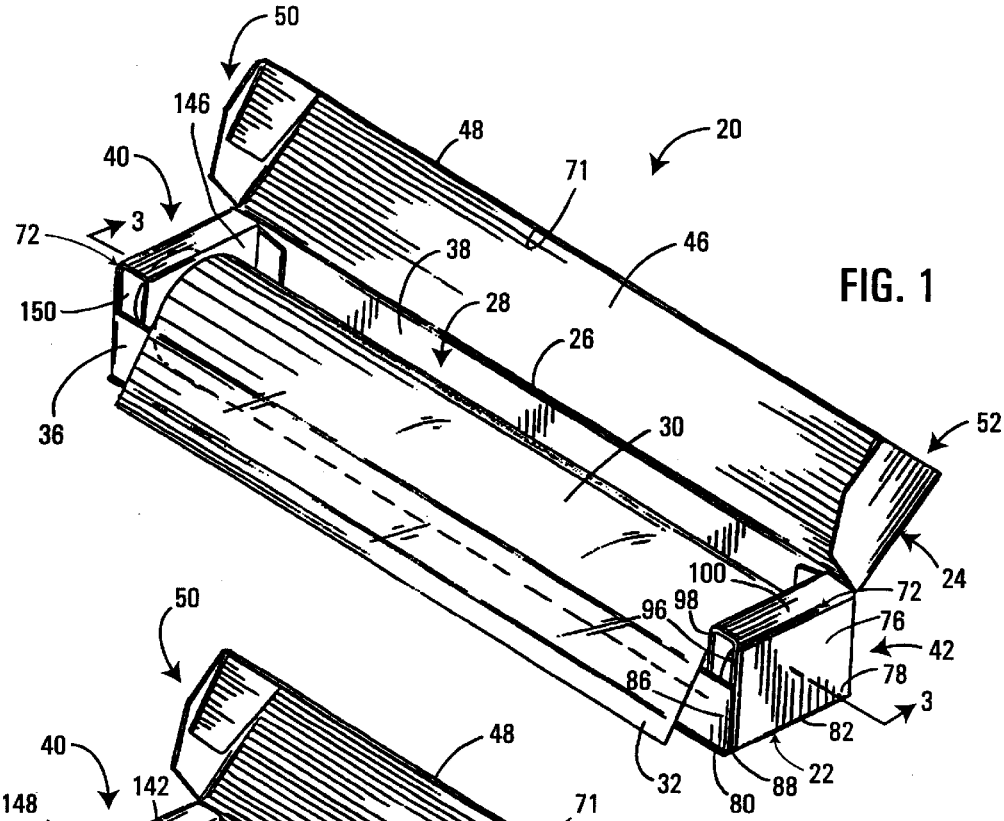
FIG. 1 is an isometric view of a carton constructed in accordance with the teachings of the invention and depicted in an assembled, open configuration with a roll of wound material positioned therein.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is cover all modifications, alternative constructions, and equivalents falling within the spirit and scope of the invention as defined by the appended claims.

DETAILED DESCRIPTION OF THE PREFERRED EMBODIMENTS

Referring now to the drawings, and with specific reference to FIG. 1, a film dispenser constructed in accordance with the teachings of the invention is generally depicted by reference numeral 20. As shown therein, film dispenser 20 includes a trunk 22 to which a lid 24 is naturally hinged at a fold 26. The trunk 22 defines an interior channel 28 in which a roll 30 of wound web material 32 is positioned. In the preferred embodiment, the trunk 22 and lid 24 are manufactured from an integral piece of material such as paperboard, cardboard, corrugated board, microfluted board, or the like, and is folded and joined in a series of consecutive steps as will be described in further detail herein to form the film dispenser 20 for the roll 30.

Figure 2:
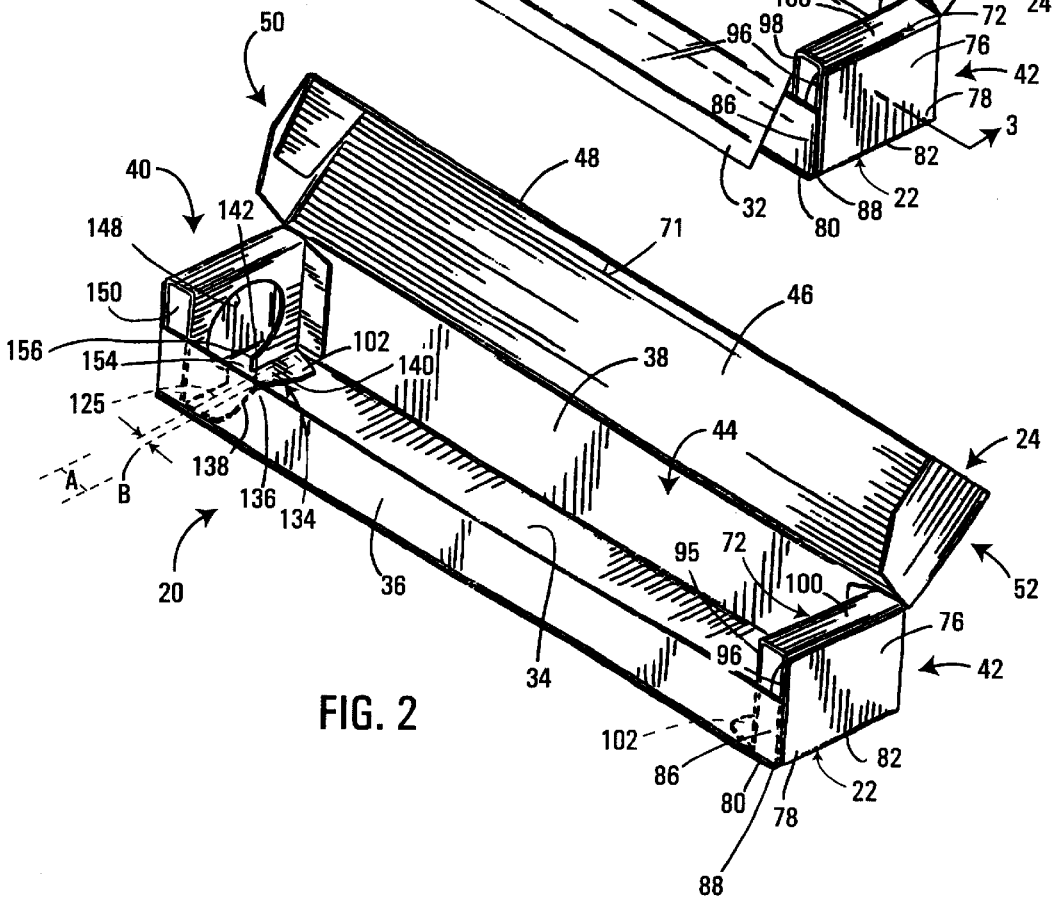
FIG. 2 is an isometric view of the carton depicted in FIG. 1 but without a roll installed.

With reference now to FIG. 2, the carton 20 is depicted without a roll 30 therein, The trunk 22 includes a bottom wall 34, a front side 36, a border 37, a back side wall 38 and first and second ends 40, 42, respectively. The front side wall 36 and back side wall 38 extend orthogonally from the bottom wall and are parallel to one another. The first end 40 and second end 42 also extend orthogonally from the bottom wall and are parallel to one another. Accordingly, the trunk 22 forms a box-like structure having an open top 44 providing access to the interior channel 28.

The lid 24 includes a top wall 46, a front wall 48 extending orthogonally from the top wall 46, and first and second opposed, parallel end walls 50, 52, respectively. The top wall 46 includes a front edge 54 which meets a top edge 56 of the front wall 48 at a fold 58 (see FIG. 4). The top wall 46 further includes a back edge 60 which meets at a top edge 62 of the back side wall 38 of the trunk 22 at the fold 26. The front wall 48 of the lid 24 further includes a bottom edge 64 which is scored or otherwise perforated at a juncture 66 with a removable tear strip 68.

As shown in FIGS. 4–7, when the carton 20 is assembled, and prior to initial use, the tear strip 68 is intact and adhered to the front side wall 36 of the trunk 22. Preferably, the tear strip 68 is adhered to the front side wall 36 with a plurality of discrete areas of adhesive (not shown). In so doing, the tear strip 68 is easily removed by a user by pulling upon an end tab 67 and along the score line 66. The series of discrete areas 69 of adhesive adequately adhere the lid 24 to the trunk 22 prior to initial use, and yet enable a user to easily pull the tear strip 68 away from the carton to gain access to the roll 30. It is preferable that the front side wall 36 include a top layer scored around the areas 69 of adhesive to further facilitate removal of the tear strip 68 when desired. While the drawings depict four areas 69, it is to be understood that other numbers of areas 69 can be employed with similarly efficacy. The number and spacing of areas 69 can be tailored to provide various retention strengths as desired.

A cutter bar 70, which may be serrated or otherwise formed with a sharpened edge, is disposed on an interior surface 71 of the front wall 48 of the lid 24 for severing strips of web material 32 from the roll 30. In alternative embodiments, the cutter bar may be located elsewhere, such as on the bottom wall 34 of the trunk 22 proximate the front side 36.

Figure 4:
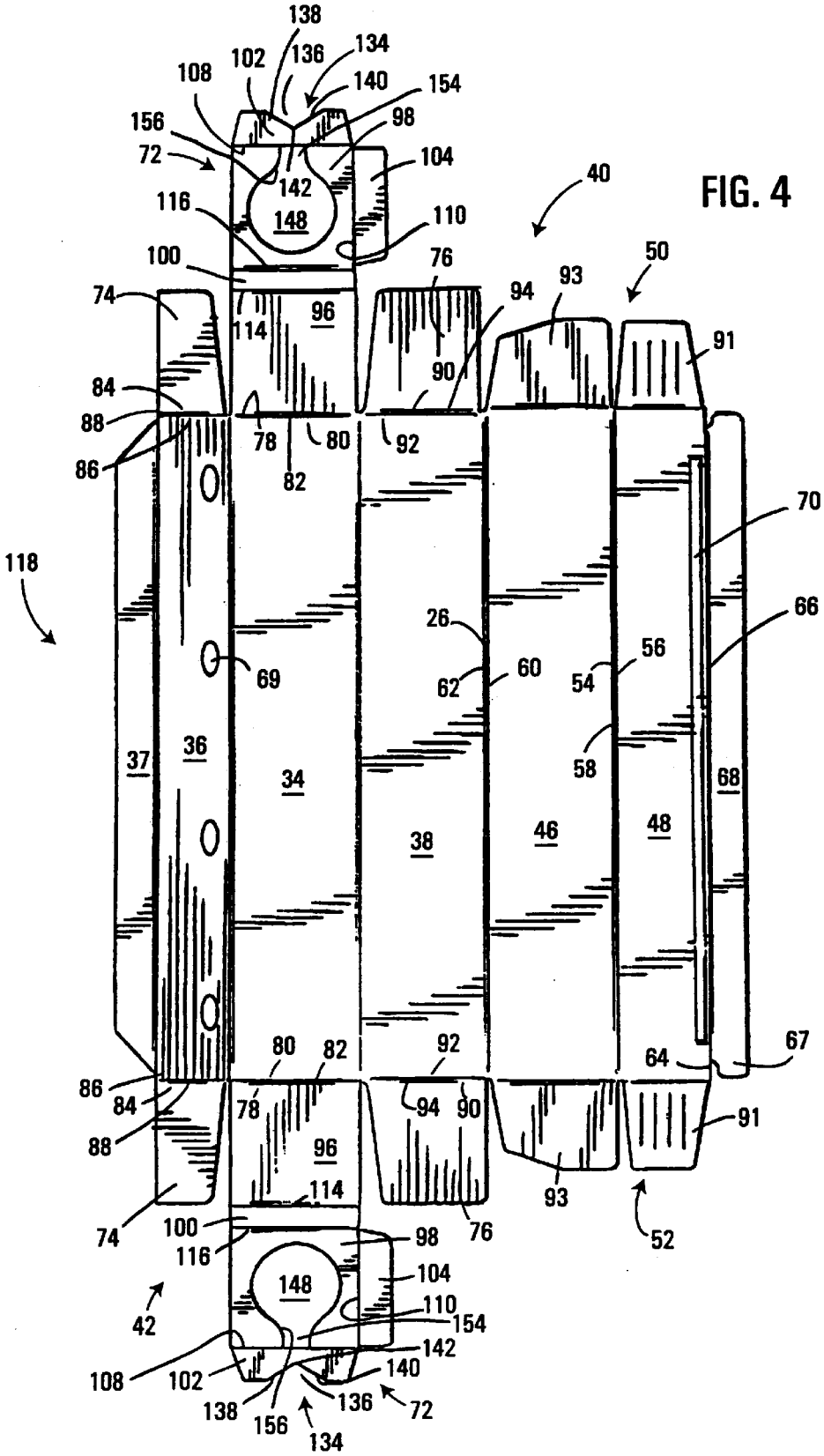
FIG. 4 is a plan view of the carton of FIG. 1 depicted in an unassembled, unfolded state.
Figure 6:
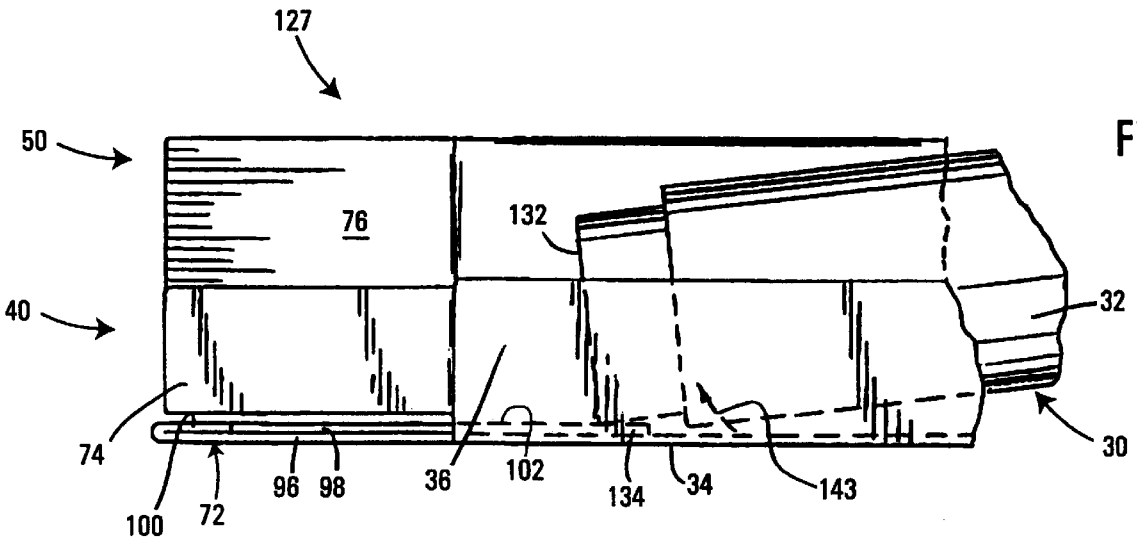
FIG. 6 is a side view of a roll entirely slid into a carton constructed in accordance with the teachings of the invention.

As shown in FIGS. 1 and 4, the end walls 40, 42, 50, and 52 are formed from a series of flaps folded in a preferred sequence and adhered relative to one another. Starting with the end walls 40 and 42 of the trunk 22, each wall 40, 42 includes a suspension flap 72, a minor flap 74, and a major flap 76. The suspension flap 72 includes a bottom edge 78 which meets a side edge 80 of the bottom wall 34 at a fold 82. The minor flap 74 includes a side edge 84 which meets a side edge 86 of the front side wall 36 at a fold 88. The major flap 76 includes a side edge 90 which meets a side edge 92 of the back side wall 38 at a fold 94. The end walls 50, 52 of the lid 24 similarly include a minor flap 91 and a major flap 93.

Each suspension flap 72 includes a number of panels, as shown in FIG. 4, which when folded and adhered in a particular sequence not only form the end walls 40 and 42, but also provide a mechanism by which the roll 30 is both retained within the trunk 22 and suspended for rotation therein. The suspension flap 72 includes an exterior wall 96 and interior wall 98, a spacer 100 joining the exterior wall 96 to the interior wall 98, a bottom strut 102 and a side strut 104. The bottom and side struts 102 and 104, respectively, extend from the interior wall 98 along folds 108 and 110, respectively. The spacer 100 meets the exterior wall 96 at a fold 114 and meets the interior wall 98 at a fold 116.

Figure 8:
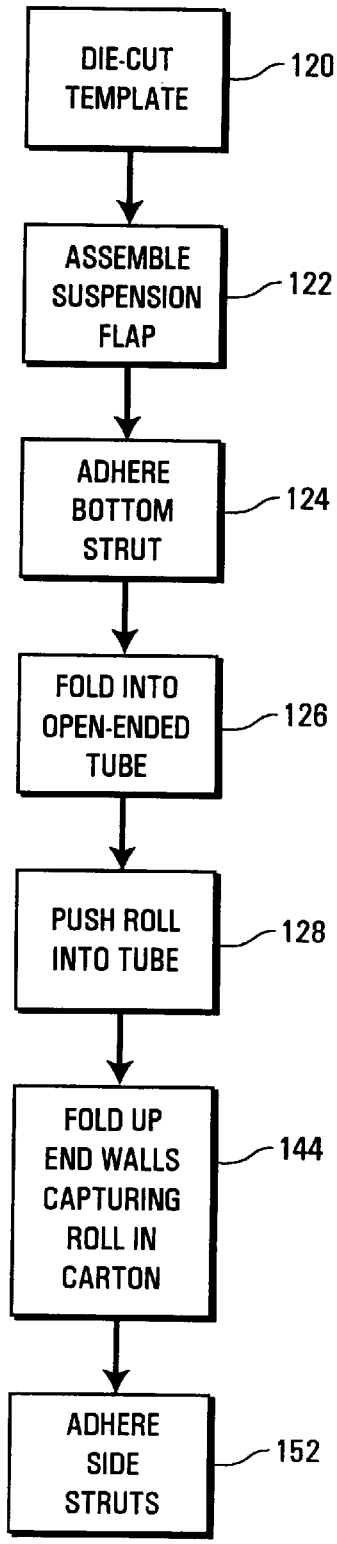
FIG. 8 is a flow chart depicting steps for carton assembly in accordance with the teachings of the invention.

During assembly of the carton 20, as shown in flow chart fashion in FIG. 8, a template 118 having the configuration depicted in FIG. 4 is cut from stock material. For example, the template 118 can be die-cut or stamped from stock paperboard material. This step is depicted as step 120 in the flow chart of FIG. 8. The suspension flap 72 is then formed in a step 122 wherein the exterior wall 96 is first folded so as to be orthogonal relative to the bottom wall 34 of the trunk 22. The spacer 100 is then folded relative to the exterior wall 96 so as to be parallel to the bottom wall 34. The struts 102 and 104 are then folded relative to the interior wall 98 so as to be orthogonal thereto as well. The interior wall 98 is then folded relative to the spacer 100 so as to be orthogonal thereto and parallel to the exterior wall 96. As shown in FIG. 8, the bottom strut 102 is then adhered to the bottom wall 38 in a step 124, using a strip of adhesive 125.

In a step 126, the template 118 is folded at folds 26 so as to form a tube 127 (see FIG. 5) having a substantially rectangular cross-section with first and second open ends.

The tear strip 68 is adhered to the front side wall 36 to maintain the tubular configuration. At the conclusion of step 126, the tube 127 is typically knocked down by folding the tube into a flat configuration. Such folding facilitates storage and shipment. For example the tube 127 may be fabricated at a first facility and vendor and subsequently shipped to a second facility for loading with the roll 30.

Figure 5:
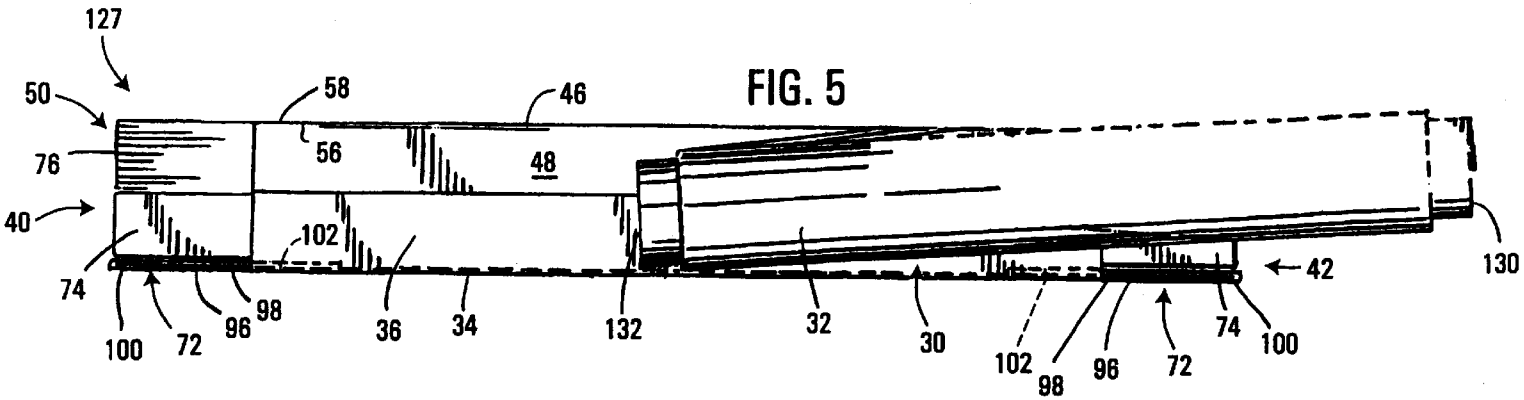
FIG. 5 is a side view of a roll being slid into the carton of FIG. 1 in accordance with the method of manufacturing of the present invention.

The tube 127 is typically loaded with the roll 30 in an automated process wherein the roll 30 is pushed into the tube 127 in a step 128. More specifically, an arm driven by an actuator, such as a linear actuator, a chain and sprocket actuator, a hydraulic actuator, or the like, pushes against a first end 130 of the roll 30 causing the second end 132 of the roll 30 to slide along the bottom wall 34 of the trunk 22 as shown in FIG. 5. For the purpose of illustration, the roll 30 is depicted at an exaggerated angle relative to the tube 127 during loading. In actual practice, the roll 30 may be substantially parallel to the tube 127. In order to facilitate such a pushing motion, the bottom strut 102 may be provided with a guide surface 134, as shown in FIG. 2. In the first depicted embodiment, the guide surface 134 is provided in the form of a wedge-shaped recess 136 which serves to funnel the second end 132 of the roll 30 up and over the bottom strut 102. More specifically, the wedge-shaped recess 136 includes first and second canted sides 138, 140 which meet at an apex 142. By so positioning the recess 136, the second end 132 initially meets the recess 136 at its widest point and slides along the canted sides 138 and 140. This in turn pushes the second roll 132 up and over the bottom strut 102 in the direction of the apex 142 as shown by an arrow 143 in FIG. 6.

Figure 7:
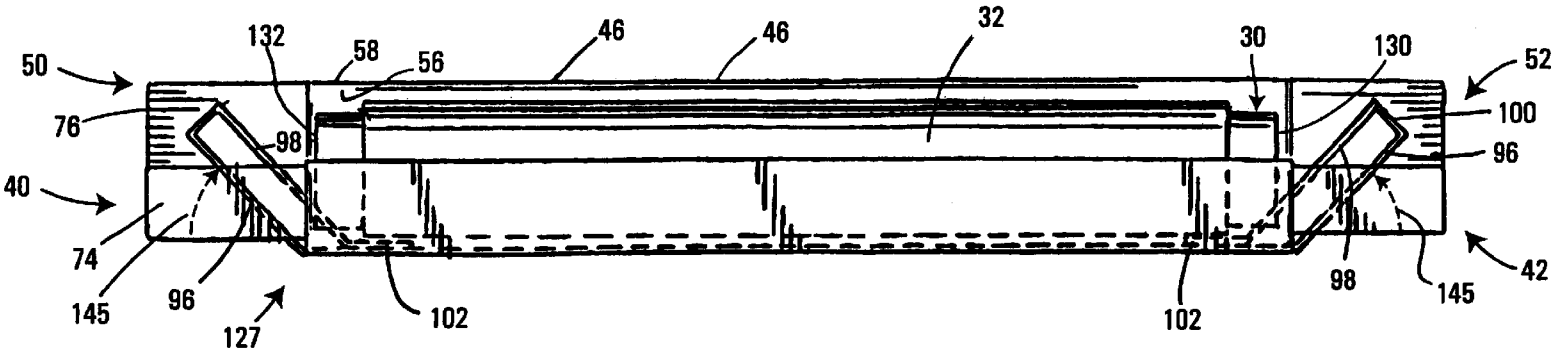
FIG. 7 is a side view of a carton constructed in accordance with the teachings of the invention and with end walls of the carton being folded upwardly to capture the roll.

Once the roll 30 is properly positioned within the trunk 22, the first and second suspension flaps 72 are folded upwardly with respect to the bottom wall 34 in a step 144 in the direction of arrows 145. Preferably, the first and second suspension flaps 72 are simultaneously folded upwardly as shown in FIG. 7, so as to lift the roll 30 off of the bottom wall 34, while at the same time capturing the first and second ends 130, 132 of the roil 30 within a retainer 146 of each suspension flap 72. In the first preferred embodiment, the retainer 146 is provided in the form of an aperture 148 (see FIG. 4) dimensioned to be slightly larger than the diameter of the roll 30. In so doing, the interior wall 98 surrounds or circumnavigates the roll 30. In this regard, it is important to note that the structure and dimensions of the suspension flaps 72 and roll 30 ensure that the roll 30 is adequately retained within the trunk 22. More specifically, the spacer 100 and parallel exterior and interior walls 96, 98, respectively, ensure that the suspension flap 72, once assembled, provides a hollow interior space 150 into which the first and second ends 130, 132 penetrate, as shown in FIG. 1. In addition, the roll 30 is sufficiently long to extend substantially from one exterior wall 96 to the other, preferably with the ends 130, 132 of the roll 30 not covered by film 32 each having a width substantially the same as the width of the space 150.

Figure 3:
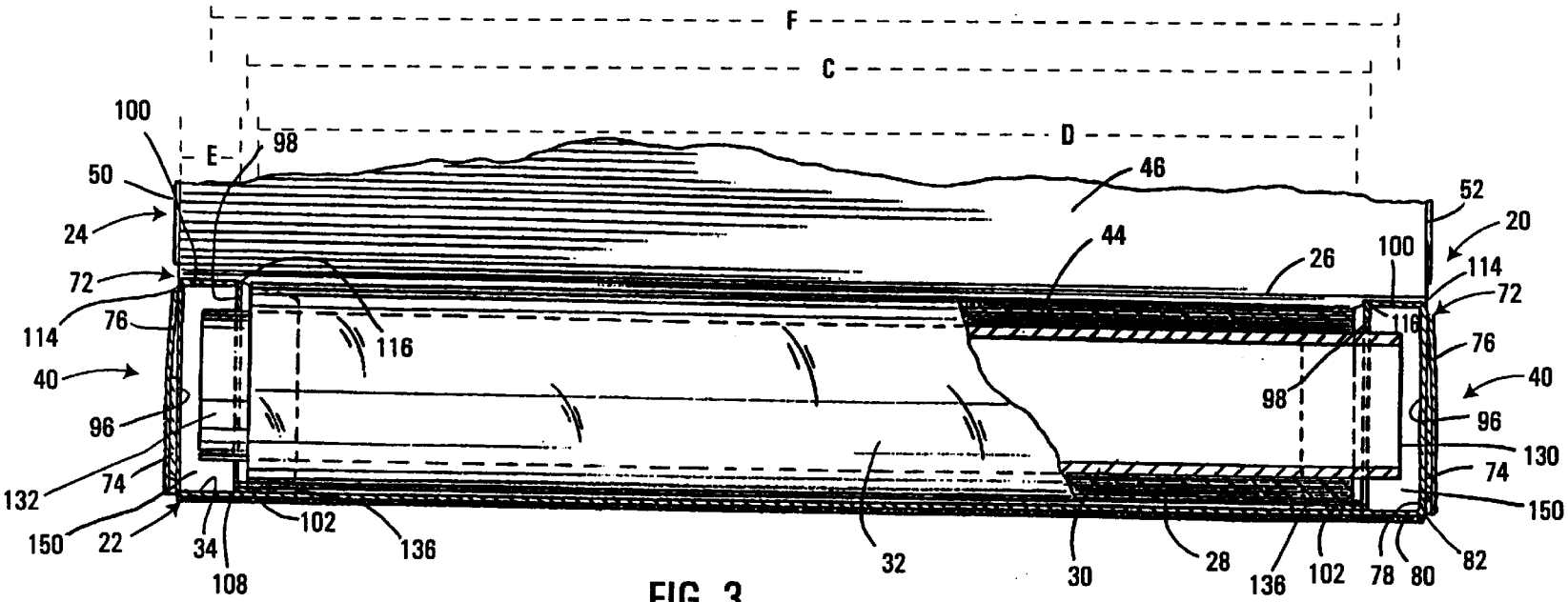
FIG. 3 is a sectional view of FIG. 1 taken along line 3—3 of FIG. 1.

In a preferred embodiment, depicted in FIGS. 2 and 3, the bottom strut 102 may have a width A of about ⅝ inches, and the strip of adhesive 125 may have a width B of ¼ inches, such that the ratio of A to B is at least 2.5. The first and second retainers may be spaced by a distance C of $11\frac{15}{16}$ inches, and the wound web material 32 may have a width of 11½ inches, such that the ratio of C to D is at least 1.03. The spacer 100 may have a width E of ⅜ inches, and the roll 30 may have a width F of 12 inches, such that the ratio of E to F is at least 0.3. The foregoing is by way of example only, various other dimensions being employable with the teachings of the invention. The inventors have found that the above dimensions provide desirable utility in the form of, among other things, improved retention of the roll 30 within the carton 20, enhanced ability of the roll 30 to rotate even in the event of the film 32 telescoping on the roll, and reduced likelihood of the adhesive 125 contacting the web material 32 or the wall 48 when in a deconstructed, flat position.

Once the suspension flaps 72 are folded upwardly so as to be orthogonal to the bottom wall 34, they may optionally be adhered in place using the side strut 104. More specifically, the side strut 104 may be adhered using adhesive against the back side wall 38. This step is depicted as step 152 in FIG. 8, and would typically be performed only when the carton 20 is hand assembled. The end walls 40, 42 are completed by inwardly folding and adhering the minor flap 74 to the exterior wall 96, and subsequently folding and adhering the major flap 76 to the minor flap 74. The end walls 50, 52 of the lid 24 are similarly formed using the minor and major flaps 91, 92, respectively.

In order to facilitate the lifting of the roll 30 off of the bottom wall 34 during the suspension step 144, each of the suspension flaps may further be provided with a funnel mouth 154 as depicted in FIG. 4. Each funnel mouth 154 is a continuation of the aperture 148 provided in the interior wall 98. The aperture 148, which is typically circular, thereby extends by way of the funnel mouth 154 toward the fold 114 proximate the spacer 100. Accordingly when the first and second suspension flaps 72 are folded upwardly, sides 156 flanking the funnel mouth 154 engage the ends 130, 132 of the roll 30 and guide the roll 30 upwardly until penetrating the apertures 148. Moreover, the existence of side struts 104 structurally fortify the interior wall 98 during the folding step. Due to the relatively thin expanses of cardboard in the interior wall 98 surrounding the apertures 148, the wall 98 might tend to crumple during the folding step 144. Using the side strut 104, this likelihood is abated. In alternative embodiments more than one side strut 104 may be employed.

Figure 9:
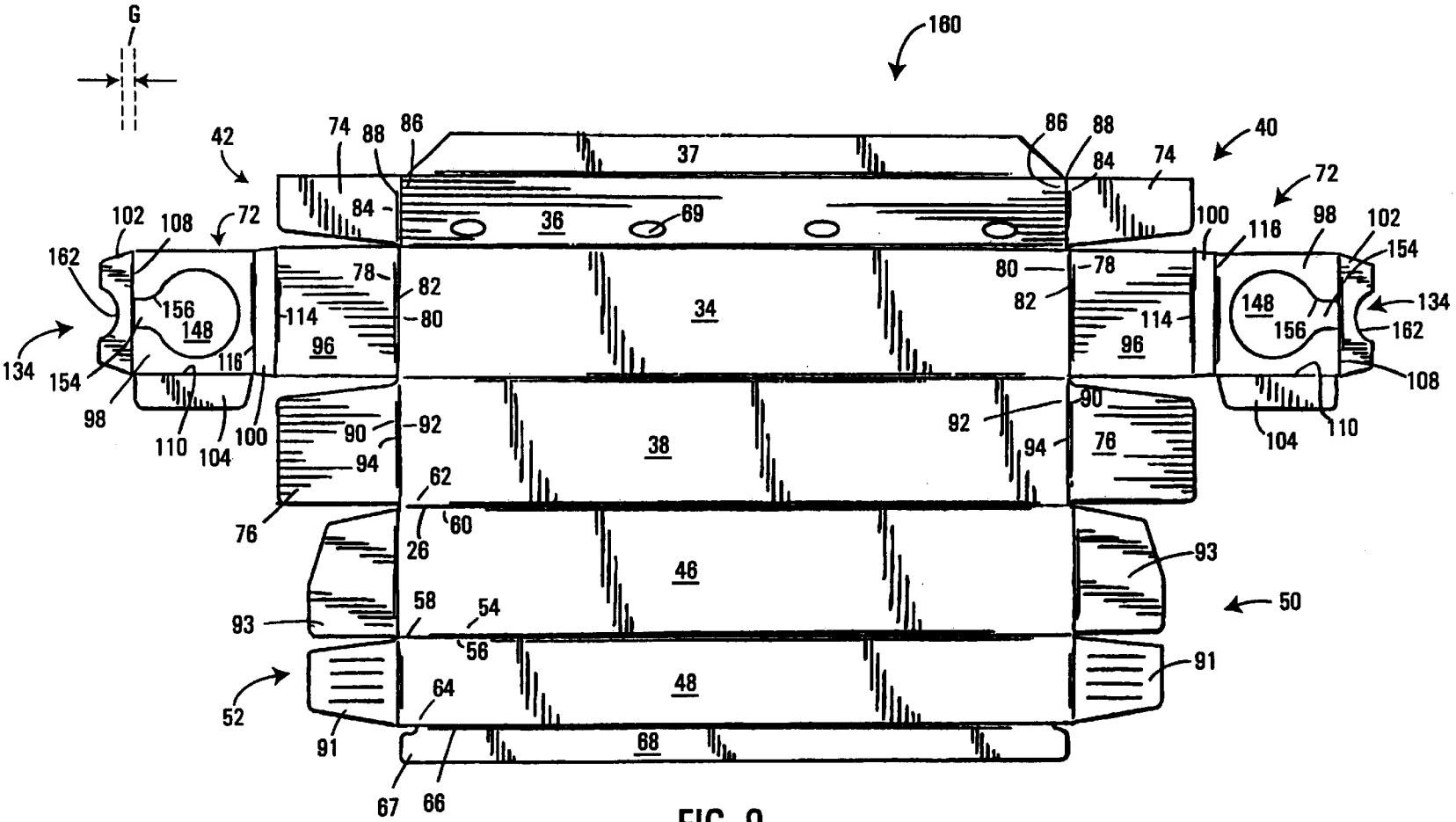
FIG. 9 is a plan view of a second embodiment of a carton constructed in accordance with the teachings of the invention and depicted in an unassembled, unfolded state.

A second preferred embodiment of a carton constructed in accordance with the teachings of the invention is depicted in FIG. 9 and is referenced to by reference numeral 160. The carton 160 is generally the same as the first embodiment depicted in FIGS. 1–7 and wherein like reference numerals apply, like reference numerals are used. One difference with regard to the second embodiment pertains to the shape of the guide surface 134. In the second embodiment, the guide surface 134 is provided in the form a semi-circular recess 162. It is important to understand that in both this embodiment and the first preferred embodiment, the bottom strut 102 is dimensioned so as to provide sufficient width so as to completely cover the adhesive 125 adhering the bottom strut 102 to the bottom wall 34 while at the same time providing a functional guide surface 134. More specifically, as shown in FIG. 9, the width of the bottom strut 102 proximate the recess 162, depicted as reference character G in FIG. 9, is sufficiently wide so as to cover the width B of the adhesive 125, even after the bottom strut 102 is adhered to the bottom wall 34, and the adhesive 125 is flattened and widened in the process. In so doing, the likelihood of the adhesive 125 engaging the roll 30 or web material 32 during assembly for usage is abated.

Figure 10:
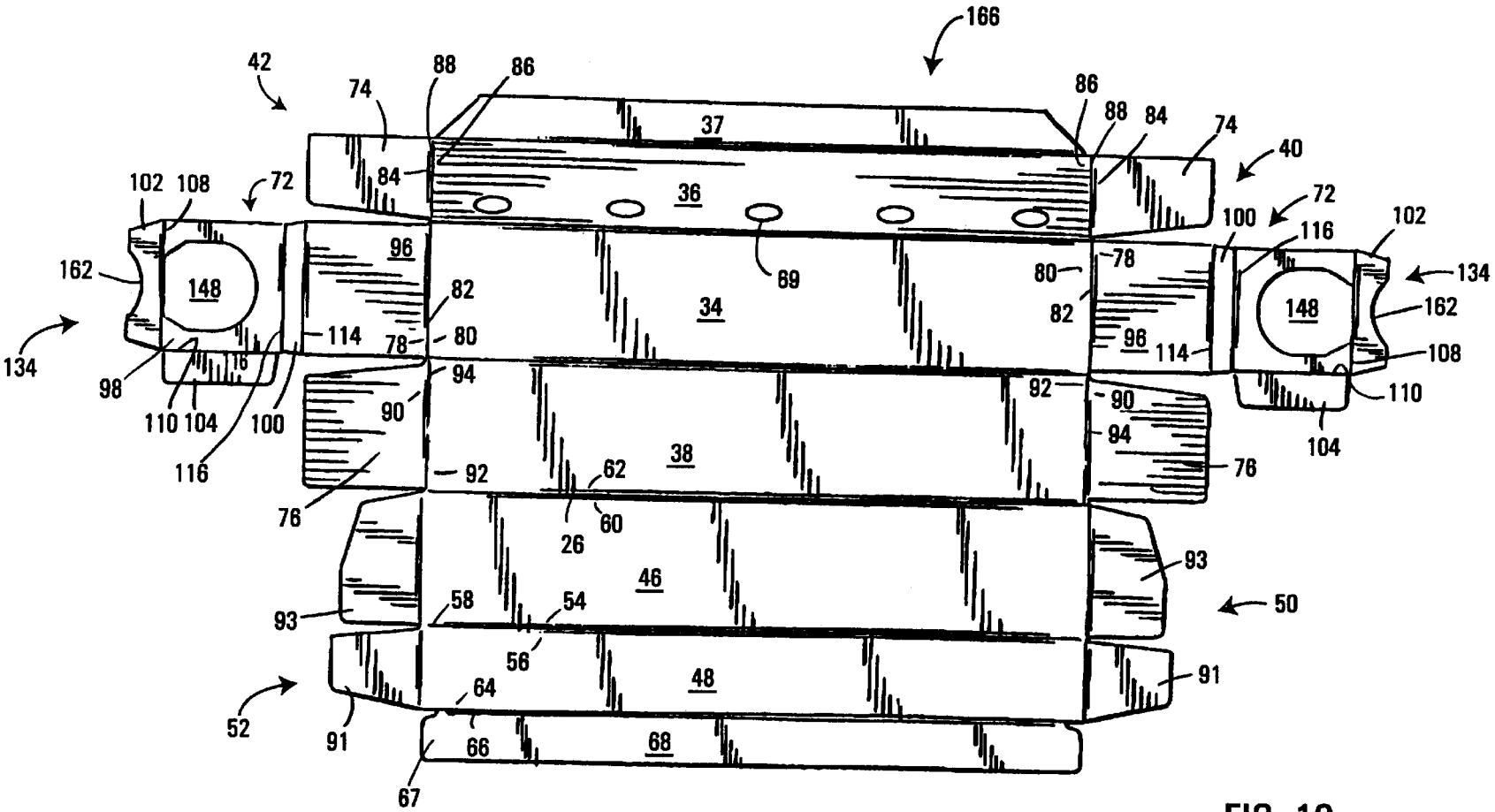
FIG. 10 is a plan view of a third embodiment of a carton constructed in accordance with the teachings of the invention and depicted in an unfolded, unassembled state.

A third preferred embodiment of a carton constructed in accordance with the teachings of the invention is depicted in FIG. 10 and referenced to by reference numeral 166. Again, where like reference numerals apply, like reference numerals are employed. In the depicted embodiment, the apertures 148 within the suspension flaps 72 are substantially lower than in the first and second embodiments. Accordingly, no funnel mouth 154 is employed, and the roll 30 is not initially suspended off of the bottom wall 34. In addition, the front side wall 36 is of a lesser height to facilitate removal of the film or web material 32 from the roll 30.

Figure 11:
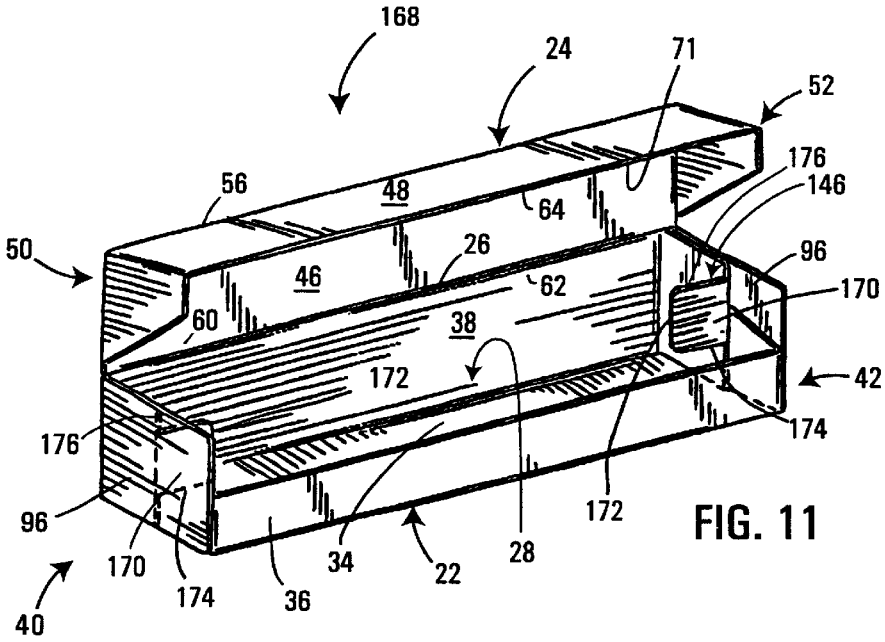
FIG. 11 is an isometric view of a fourth embodiment of a carton constructed in accordance with the teachings of the invention.
Figure 12:
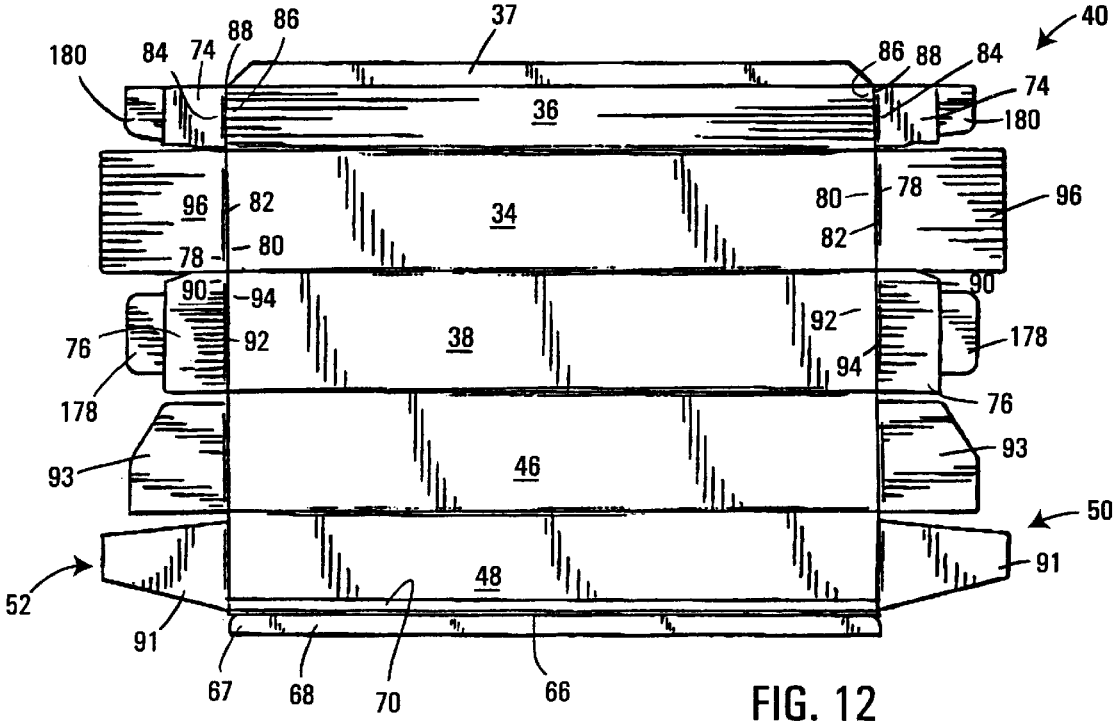
FIG. 12 is a plan view of the carton of FIG. 11 and depicted in an unassembled, unfolded state.

FIGS. 11 and 12 depict a fourth preferred embodiment of a carton 168 constructed in accordance with the teachings of the present invention. As with the other embodiments, where like reference numerals apply, like reference numerals are employed in the figures. As opposed to the first, second, and third embodiments, which provide retainers 146 which surround the roll 30, the fourth embodiment employs retainers 146 which penetrate through the first and second ends 130 and 132, respectively, of the roll 30. As shown in FIG. 11, each retainer 46 is provided in the form of an inwardly extending arm 170. Each arm 170 is substantially planar in configuration and includes a front edge 172, a bottom edge 174, and a top edge 176. As shown in the plan view depicted in FIG. 12, each arm 170 is dual-plied in that a first ply 178 extends from the flap 76, and a second ply 180 extends from the flap 74. Accordingly, when the carton 168 is assembled, the first and second plies 178 and 180 are aligned together to provide a more rigid retainer 146 for support of the roll 30. Alternatively, the plies 178, 180 may be adhered together. When the roll 30 is mounted within the carton 168, the interior surface of the roll 30 rests upon the top edge 176 and rotates on the arms 170.

Figure 13:
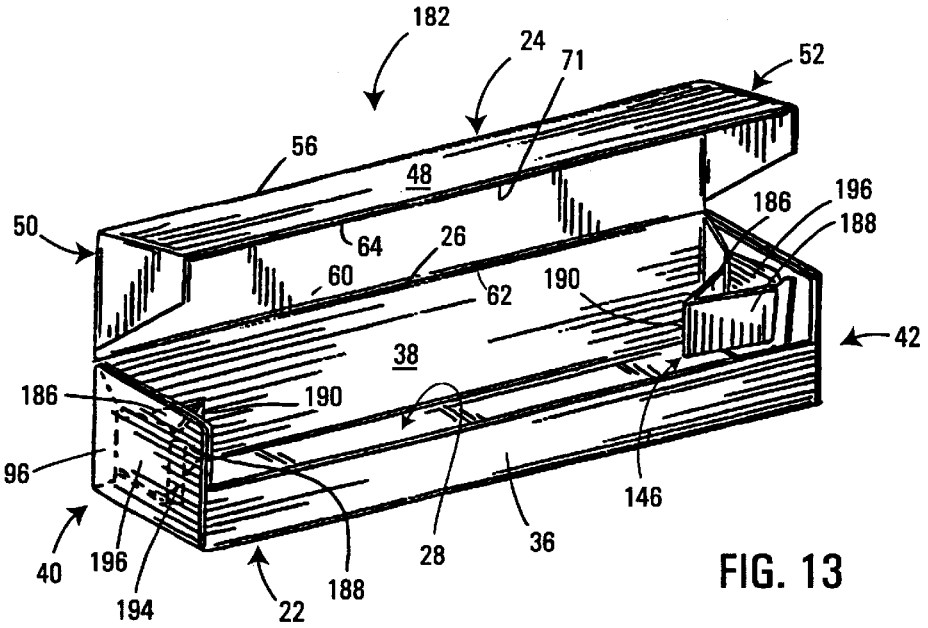
FIG. 13 is an isometric view of a fifth embodiment of a carton constructed in accordance with the teachings of the invention.
Figure 14:
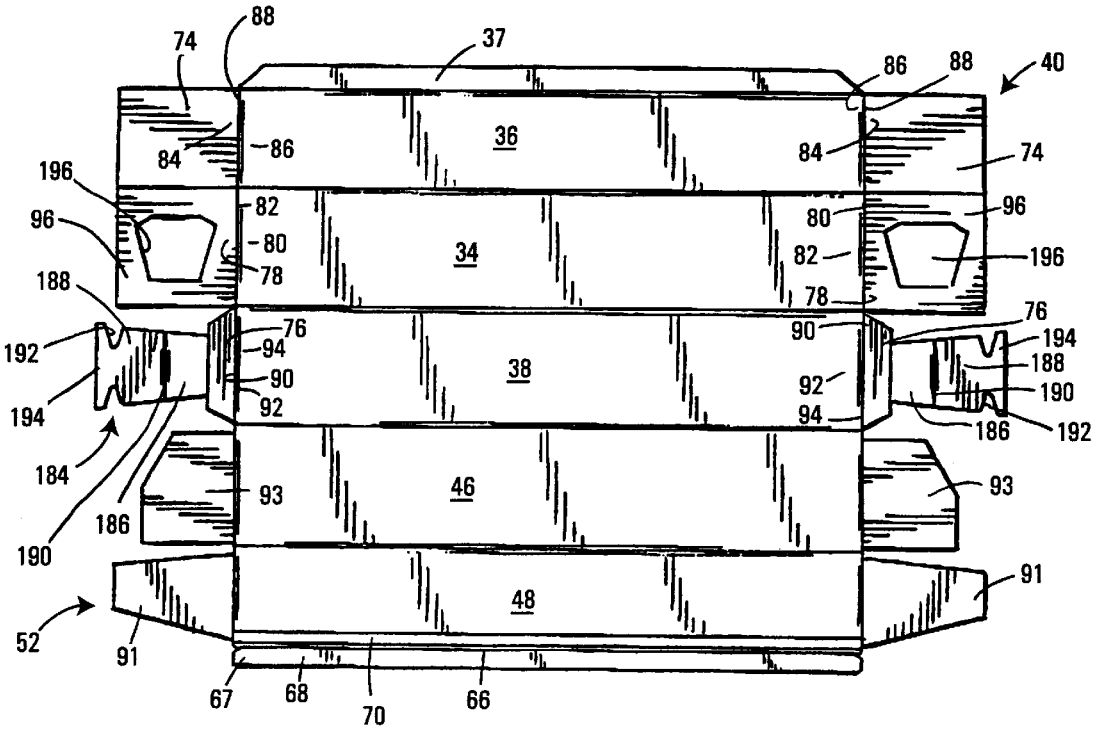
FIG. 14 is a plan view of the carton depicted in FIG. 13 but depicted in a unassembled and unfolded state.

FIGS. 13 and 14 depict a fifth preferred embodiment of a carton 182 constructed in accordance with the teachings of the invention. As with the other embodiments, where like reference numerals apply, like reference numerals are employed. As shown best in FIG. 13, the retainers 146 of the fifth embodiment are substantially wedge-shaped. Similar to the fourth embodiment, the wedge-shaped retainers 146 are designed to penetrate the first and second ends 130, 132 of the roll 30 for retention and suspension of the roll within the trunk 22. Each of the wedge-shaped retainers 146 is formed by a foldable leg 184 extending from the flap 76. Each foldable leg 184 includes a first extension 186 which meets a second extension 188 at a fold 190. As shown best in FIG. 14, the foldable leg 184 tapers in width from a narrow dimension proximate the flap 74, to a wide dimension at the free end of the second extension 188. In addition, the second extension 188 includes a pair of opposed notches 192 which partially divide the second extension 188 and thereby form a locking tab 194. The locking tab 194 cooperates with a slot 196 formed in the end walls 40, 42 to lock the retainers 146 in the operative position depicted in FIG. 13. More specifically, once the 194 is inserted through the slot 196, the tab 194 is folded parallel to the end walls 40, 42 and adhered thereto. When the roll 30 is loaded into the trunk 22, the first and second ends 130, 132 are supported by the retainers 146 for suspension and rotation thereon.

From the foregoing, it will be appreciated that the present invention provides carton for retention, suspension, and dispersal of rolls of web material. It also provides a method for manufacturing such a carton in an automated process.

What is claimed is:

1. A film dispenser, comprising:

a body having a base, first and second sides extending orthogonally from the base, and first and second ends extending from the base, the body defining an interior channel;

a lid hinged to the body and movable between closed and open positions, the lid preventing user access to the interior channel when in the closed position, the interior channel being user accessible when the lid is in the open position;

a roll of film positioned within the interior channel, the roll including a core around which is wound a web of film, the web being narrower than the core, the core including first and second ends; and first and second retainers positioned proximate the first and second body ends, each retainer including a bearing plate substantially parallel to one of the first and second body ends, a spacer interconnecting a top edge of the bearing plate to a top edge of one of the first and second ends, and a flap connecting a bottom edge of the bearing plate to the base, each flap including a guide surface to facilitate loading of the roll into the interior channel, the spacer and flap being substantially parallel to the body base, each bearing plate including an aperture receiving one of the core ends.

2. The film dispenser of claim 1, wherein each of the guide surfaces includes a recess within the flap, the recess opening toward the bearing plate.

3. The dispenser of claim 2, wherein the recess is wedge-shaped having an apex, the apex being proximate the bearing plate.

4. The dispenser of claim 2, wherein the recess is semi-circular in shape.

5. The dispenser of claim 2, wherein the flap is adhered to the body base with adhesive, the flap being sufficiently wide to prevent exposure of the adhesive to the roll.

6. The dispenser of claim 5, wherein the flap has a width A and the adhesive has a width B, the ratio of A to B being at least 2.5.

7. The dispenser of claim 1, wherein the first and second retainers are spaced apart sufficiently to provide adequate clearance of the film in the event of film telescoping on the roll.

8. The dispenser of claim 7, wherein the first and second retainers are spaced by a distance C, and the film has a width D, the ratio of C to D being at least 1.03.

9. The dispenser of claim 1, wherein the spacer has a width E and the roll cone has a length F, the ratio of E to F being at least 0.03.

10. The dispenser of claim 1, wherein each bearing plate aperture is substantially circular and wherein each bearing plate further includes a mouth extending from the circular aperture to the flap.

* * * * *

UNITED STATES PATENT AND TRADEMARK OFFICE

CERTIFICATE OF CORRECTION

PATENT NO. : 6,564,942 B1 
DATED : May 20, 2003
INVENTOR(S) : Cristopher M. Shiffler et al.

It is certified that error appears in the above-identified patent and that said Letters Patent is hereby corrected as shown below:

Column 8,
Line 52, please delete "cone" and insert -- core --

Signed and Sealed this

Sixth Day of July, 2004

JON W. DUDAS
*Acting Director of the United States Patent and Trademark Office*